US009597913B2

(12) United States Patent
Quintens et al.

(10) Patent No.: US 9,597,913 B2
(45) Date of Patent: Mar. 21, 2017

(54) IMAGE RECEIVING MATERIAL FOR OFFSET PRINTING

(75) Inventors: Dirk Quintens, Westerlo (BE); Dirk Kokkelenberg, St Niklaas (BE)

(73) Assignee: Agfa-Gevaert NV, Mortsel (BE)

( * ) Notice: Subject to any disclaimer, the term of this patent is extended or adjusted under 35 U.S.C. 154(b) by 107 days.

(21) Appl. No.: 13/825,774

(22) PCT Filed: Nov. 24, 2011

(86) PCT No.: PCT/EP2011/070932

§ 371 (c)(1),
(2), (4) Date: Mar. 22, 2013

(87) PCT Pub. No.: WO2012/069586

PCT Pub. Date: May 31, 2012

(65) Prior Publication Data

US 2013/0209783 A1 Aug. 15, 2013

Related U.S. Application Data

(60) Provisional application No. 61/418,408, filed on Dec. 1, 2010.

(30) Foreign Application Priority Data

Nov. 26, 2010 (EP) ..... 10192655

(51) Int. Cl.

| | |
|---|---|
| ***B41M 5/00*** | (2006.01) |
| ***B41M 5/52*** | (2006.01) |
| ***D21H 19/56*** | (2006.01) |
| *D21H 13/10* | (2006.01) |
| *D21H 13/12* | (2006.01) |
| *D21H 13/16* | (2006.01) |
| *D21H 19/58* | (2006.01) |
| *D21H 19/60* | (2006.01) |
| *D21H 19/84* | (2006.01) |

(52) U.S. Cl.

CPC ..... *B41M 5/52* (2013.01); *B41M 5/5254* (2013.01); *D21H 19/56* (2013.01); *D21H 13/10* (2013.01); *D21H 13/12* (2013.01); *D21H 13/16* (2013.01); *D21H 19/58* (2013.01); *D21H 19/60* (2013.01); *D21H 19/84* (2013.01); *Y10T 156/10* (2015.01); *Y10T 428/249971* (2015.04); *Y10T 428/249974* (2015.04)

(58) Field of Classification Search

CPC ..... C08K 3/36; C09D 175/04; B32B 27/08; B32B 27/32; B32B 27/36; B41M 5/508; B41M 5/5281; D21H 13/10; D21H 13/12

USPC ..... 428/331, 423.1, 500

See application file for complete search history.

(56) References Cited

U.S. PATENT DOCUMENTS

| | | | | |
|---|---|---|---|---|
| 5,075,153 | A * | 12/1991 | Malhotra | B41M 5/42 347/105 |
| 5,141,797 | A * | 8/1992 | Wheeler | 428/195.1 |
| 5,397,637 | A | 3/1995 | Asami et al. | |
| 6,300,393 | B1 | 10/2001 | Hudson et al. | |
| 6,849,325 | B2 | 2/2005 | Murschall et al. | |
| 8,329,784 | B2 | 12/2012 | Quintens et al. | |
| 2003/0138604 | A1* | 7/2003 | Landry-Coltrain et al. | 428/195 |
| 2004/0146699 | A1 | 7/2004 | Dalgleish et al. | |
| 2006/0257593 | A1 | 11/2006 | Haenen | |
| 2011/0008542 | A1* | 1/2011 | Zeng et al. | 427/288 |

FOREIGN PATENT DOCUMENTS

| | | | |
|---|---|---|---|
| EP | 0564911 | A2 | 10/1993 |
| EP | 0570795 | A1 | 11/1993 |
| EP | 0686662 | A2 | 12/1995 |
| EP | 1743976 | A1 | 1/2007 |
| EP | 2103736 | A1 | 9/2009 |
| GB | 2177413 | A | 1/1987 |
| JP | 2011107194 | A | 6/2001 |
| JP | 2004268287 | A | 9/2004 |
| JP | 2008296465 | A | 12/2008 |
| JP | 2010099991 | A | 5/2010 |
| WO | WO 03033577 | A1 | 4/2003 |
| WO | WO 2008/040699 | A1 | 4/2008 |
| WO | WO 2008040670 | A1 | 4/2008 |
| WO | WO 2008040701 | A1 | 4/2008 |
| WO | WO 2008116797 | A1 | 10/2008 |
| WO | WO 2008116869 | A1 | 10/2008 |

OTHER PUBLICATIONS

International Preliminary Report on Patentability in corresponding International Patent Application No. PCT/EP2011/070932, mailed May 28, 2013.

International Search Report in European Patent Application No. PCT/EP2011/070932, mailed on Dec. 1, 2012.

* cited by examiner

*Primary Examiner* — Betelhem Shewareged

(74) *Attorney, Agent, or Firm* — Leydig, Voit & Mayer, Ltd.

(57) ABSTRACT

The invention relates to an image receiving material for offset printing comprising a support and an image receiving layer, the image receiving layer comprising a porous pigment and an aqueous dispersion of a polymer particle characterized in that the image receiving layer further comprises a copolymer comprising alkylene and vinyl alcohol units.

10 Claims, No Drawings

IMAGE RECEIVING MATERIAL FOR OFFSET PRINTING

CROSS-REFERENCE TO RELATED APPLICATIONS

This patent application is a U.S. National Phase of International Application No. PCT/EP2011/070932, filed Nov. 24, 2011, which claims the benefit of European Patent Application No. 10192655.8, filed Nov. 26, 2010, and U.S. Provisional Patent Application No. 61/418,408, filed Dec. 1, 2010, the disclosures of which are hereby incorporated by reference in their entireties.

FIELD OF THE INVENTION

The present invention relates to an image receiving material for offset printing, in particular to a synthetic paper that can be used for offset printing.

BACKGROUND OF THE INVENTION

Offset printing on paper is a widely used printing process. Instead of conventional cellulose paper supports, optionally provided with one or more additional layers, so called plastic or synthetic papers are also available. An advantage of such plastic or synthetic papers is their outdoor usability due to their improved resistance towards moisture.

Synthetic papers may be classified into two different types: one with a fibrous structure comprising synthetic fibers made from for example polyamides, polyester, or polyolefins; and one in which a film is directly extruded from a thermoplastic polymer.

Extruded films typically have a smooth surface. There are no cavities with capillary activity such as between the fibers of cellulose paper or synthetic fiber webs. The combination of a smooth surface, low absorbing power and a non-polar structure often makes it difficult to print on such polymer films: drying times are long, and the adhesion of the printing ink is poor.

Extruded films are typically made from polyethylene, polypropylene or polyester. By the incorporation of "voids" and/or opacifying pigments in for example the polyester film, an opaque plastic paper can be obtained, such as for example disclosed in WO2008040670, WO2008040701, WO2008116869 and WO2008116797.

To improve the printability, dedicated ink receiving layers have been provided on plastic supports. See for example EP-A 1743976, US20060257593, US20040146699, WO2003033577, U.S. Pat. No. 6,300,393 and JP 11-107194, U.S. Pat. No. 5,397,637 and GB2177413.

An example of a synthetic paper for offset printing is disclosed in EP-A 2103736. It comprises an optionally subbed support and a single layer, the single layer having a layer thickness of at least 3 μm, a pore volume of at least 1.2 $ml/m^2$ and comprising at least one porous pigment, at least one latex and at least one water soluble binder. The water soluble binder is a polyvinyl alcohol-polyvinyl acetate copolymer.

It has been observed that while or after printing on synthetic paper, the blanket roller may be contaminated with "dust", the dust originating from the ink receiving layer. Such a contamination of the blanket roller with dust may result in printing artefacts. Such a contamination of the blanket roller worsen as more prints are made on synthetic paper without cleaning the blanket roller.

As synthetic paper is often used outdoors, the coating has to be as resistant as possible to moisture. Even under moist conditions, the scratch resistance of the ink receiving layer must be sufficient to avoid damage of the printed image upon contact.

SUMMARY OF THE INVENTION

It is an object of the present invention to provide an image receiving material for offset printing which has an improved water resistance and which has been improved with respect to contamination of the blanket roller.

The object of the present invention has been realized by an image receiving material for offset printing comprising a support and an image receiving layer, the image receiving layer comprising a porous pigment and an aqueous dispersion of a polymer particle characterized in that the image receiving layer further comprises a copolymer comprising alkylene and vinyl alcohol units.

DETAILED DESCRIPTION OF THE INVENTION

The image receiving material for offset printing according to the present invention comprises a support and an image receiving layer, the image receiving layer comprising a porous pigment and an aqueous dispersion of a polymer particle characterized in that the image receiving layer further comprises a copolymer comprising alkylene and vinyl alcohol units.

Copolymer comprising alkylene and vinyl alcohol units.

The image receiving layer comprises a copolymer comprising alkylene and vinyl alcohol units. The alkylene units are preferably ethylene units.

The copolymer is preferably prepared by hydrolysis of a copolymer comprising vinyl ester units and alkylene units wherein the vinyl ester units are partly or totally converted by hydrolysis to vinyl alcohol units. The vinyl ester units are preferably vinyl acetate.

The amount of vinyl ester units converted to vinyl alcohol units is typically defined by the degree of hydrolysis (in mol %). The degree of hydrolysis is preferably at least 85 mol %, more preferably at least 90 mol %.

A particularly preferred copolymer is a copolymer comprising vinyl alcohol units, vinyl acetate units and ethylene units.

The copolymer comprising vinyl alcohol and alkylene units is preferably water soluble. Preferably, the copolymer has a solubility in water at room temperature up to 2 wt. %, more preferably up to 4 wt. %; most preferably up to 5 wt. %. To improve the solubility, minor amounts of an organic solvent, for example fenoxyethanol, may be added. When organic solvent is used, the amount is preferably less than 5 wt. %, preferably less than 2.5 wt. %

To prepare stable solutions, it may be necessary to heat the solution up to 90-95° C. while stirring, to keep it at that temperature while stirring for 1 or 2 hours and then cooling it down to room temperature.

The amount of ethylene units in the copolymer is preferably between 0.1 and 20 wt. %, more preferably between 0.25 and 15 wt. %, most preferably between 0.50 and 10 wt. %.

When considering the amount of ethylene units in the copolymer in mol %, the amount is preferably between 0.25 and 25 mol %, more is preferably between 0.50 and 20 mol %, most preferably between 1.0 and 15 mol %.

Examples of commercially available copolymers (all from KURARAY) comprising vinyl alcohol and ethylene units are given in Table 1, together with the degree of hydrolysis and the amount of ethylene units (based on commercial information from KURARAY). Regarding the ethylene content, the numbers 1 to 4 reflect the amount in that a higher number means a higher amount of ethylene.

TABLE 1

| Product name | Degree of hydrolysis (mol %) | Ethylene content |
|---|---|---|
| Exceval AQ-4104 | 98.0-99.0 | 4 |
| Exceval HR-3010 | 99.0-99.4 | 3 |
| Exceval RS-2117 | 97.5-99.0 | 2 |
| Exceval RS-1717 | 92.0-94.0 | 1 |
| Exceval RS-1713 | 92.0-94.0 | 1 |
| Exceval RS-4105 | 97.5-99.0 | 4 |
| Exceval RS-2713 | 92.0-94.0 | 2 |
| Exceval RS-2817 | 95.5-97.5 | 2 |

A quantitative analysis by means of element analysis, corrected for the water content of the samples and neglecting the vinyl acetate content, indicated that the tested copolymers have an ethylene content up to approximately 10 wt. % (or approximately 15 mol %) Two or more different copolymers comprising vinyl alcohol and ethylene units may be used in the image receiving layer.

The image receiving layer may also comprise, in addition to the copolymer comprising vinyl alcohol and ethylene units, other types of, preferably water soluble, copolymers such as polyvinyl-polyvinylacetate copolymers, carboxy-modified polyvinyl alcohol, carboxymethyl-cellulose, hydroxyethylcellulose, cellulose sulfate, polyethylene oxides, gelatin, cationic starch, casein, sodium polyacrylate, styrene-maleic anhydride copolymer sodium salt, sodium polystyrene sulfonate. Among these, vinyl alcohol-vinyl acetate copolymers such as disclosed in EP2103736, paragraph [79]-[82] are preferred.

The total amount of the copolymer comprising vinyl alcohol and ethylene units in the image receiving layer is preferably between 0.05 and 1.0 g/m$^2$, more preferably between 0.10 and 0.75 mg/m$^2$, most preferably between 0.15 and 0.45 mg/m$^2$.

The ratio of the amount of the copolymer comprising vinyl alcohol and ethylene units to the amount of porous pigment, both present in the image receiving layer, is preferably between 0.05 and 0.50, more preferably between 0.10 and 0.25.

Aqueous Dispersion of Polymer Particles

The image receiving layer comprises an aqueous dispersion of polymer particles, often referred to as a latex.

A preferred latex is an acrylic latex, a polyester latex or a polyurethane latex. Particularly preferred, an anionic acrylic or polyurethane latex is used. The polyurethane latex is preferably an aliphatic polyurethane latex.

Suitable latexes are given in Table 2.

TABLE 2

| Product name | Producer | comonomers | | |
|---|---|---|---|---|
| Joncryl FLX5000 | BASF | styrene | 2-ethyl-hexyl acrylate/ α-methyl-styrene | ammonium acrylate |
| Joncryl 8078 | BASF | styrene | α-methyl-styrene | ammonium acrylate |

TABLE 2-continued

| Product name | Producer | comonomers | | |
|---|---|---|---|---|
| Dispercoll U53 | BAYER | | aliphatic PU | |
| Joncryl FLX5010 | BASF | styrene | acrylate | ammonium acrylate |
| Joncryl 8050 | BASF | styrene | acrylate | methacrylate |
| Hycar PC84 | Dow Chemical | styrene | acrylic acid | acrylonitrile ethyl acrylate N-hydroxy-methyl-acrylamide |
| Carboset GA2364 | Goodrich | styrene | acrylate | |
| Joncryl 8385 | BASF | quat. mod | acrylate | |
| Enorax PU950 | Collano | cationic | PU | |
| wac-17XC | Takamatu Oil & Fat Co. Ltd | anionic | polyester PU | |
| Crom-elastic C4480 | Cromogenia-units S.A. | cationic | aliphatic PU | |
| Mowilith DM 2452 | Clariant | vinyl acetate | veova (vinyl versatate) | acrylate |
| Wellpur FM10C | Van Camp Chemicals | cationic | aliphatic PU | |
| Neorez R989 | Avecia | | aliphatic PU | |
| Jetsize CE225 | Eka Nobel | cationic monomer | styrene | acrylate |
| Hycar 26084 | Lubriziol | | carboxy-modified acrylic | |
| Hycar 2679 | Lubrizol | acrylic | | |
| Hycar 2671 | Lubrizol | | acrylate | acrylonitrile |
| Impranil DLU | BAYER | | anionic aliphatic | polyester-polyurethane |
| Impranil LP RSC1997 | BAYER | | | polyurethane |
| Impranil LP RSC3040 | BAYER | | | polyurethane |
| Bayhydrol XP2558 | BAYER | | | |
| Airflex EP17 | Air Products | | vinyl acetate | ethylene |
| Polysol EVA550 | Showa Denko K.K. | | vinyl acetate | ethylene |

The latex may be a self-crosslinking latex.

Suitable self-crosslinking resins are given in Table 3.

TABLE 3

| Product name | Producer | Type |
|---|---|---|
| Acronal LR 8977 | BASF | acrylic |
| Acronal S 760 | BASF | acrylic |
| Joncryl 1580 | BASF | acrylic |
| Joncryl 8380 | BASF | acrylic |
| Joncryl 8383 | BASF | acrylic |
| Joncryl 8384 | BASF | acrylic |
| Joncryl 8385 | BASF | acrylic |
| Joncryl 8386 | BASF | acrylic |
| Joncryl 8300 | BASF | acrylic |
| Joncryl 8311 | BASF | acrylic |
| Luhydran S 937 T | BASF | acrylic |
| NeoCryl XK-98 | DSM Neo-Resins | acrylate |
| NeoPac R-9029 | DSM Neo-Resins | aliphatic urethane |

Porous Pigment

The image receiving layer comprises a porous pigment. The porous pigment may be an inorganic pigment and/or a polymeric pigment. Suitable pigments are those of which the primary particles have an internal porosity. However, suitable pigments are also those of which the primary particles do not have an internal porosity but which form secondary particles as a result of an aggregation of the primary particles.

Preferred pigments are inorganic pigments having a specific surface of at least 100 $m^2/g$ and a porosity of at least 1.2 $ml/m^2$.

The average particle diameter of the pigments is preferably between 1 and 10 μm, more preferably between 2 and 7.5 μm.

Suitable porous inorganic pigments are given in Table 4.

TABLE 4

| Product name | Producer | Chemical composition | ϕ [μm] |
|---|---|---|---|
| Sunsphere H53 | Asahi Glass | $SiO_2$ | 5 |
| Sunsphere H33 | Asahi Glass | $SiO_2$ | 3 |
| Sunsphere H52 | Asahi Glass | $SiO_2$ | 5 |
| Sunsphere H32 | Asahi Glass | $SiO_2$ | 3 |
| Sunsphere H52 | Asahi Glass | $SiO_2$ | 5 |
| Sunsphere H32 | Asahi Glass | $SiO_2$ | 3 |
| Sunsphere H51 | Asahi Glass | $SiO_2$ | 5 |
| Sunsphere H31 | Asahi Glass | $SiO_2$ | 3 |
| Sunsil 130H-SC | Sunjin | $SiO_2$ | 7 |
| Sunsil 130SH | Sunjin | $SiO_2$ | 7 |
| Sunsil 130XH | Sunjin | $SiO_2$ | 7 |
| Syloid C803 | Grace-Davison | $SiO_2$ | 3.4-4.0 |
| Syloid C807 | Grace-Davison | $SiO_2$ | 6.7-7.9 |
| Syloid C2006 | Grace-Davison | $SiO_2$ | 5.4-6.6 |
| Syloid ED2 | Grace-Davison | $SiO_2$ | 3.9 |
| Syloid ED5 | Grace-Davison | $SiO_2$ | 8.4-10.2 |
| Syloid W500 | Grace-Davison | $SiO_2$ | 7.8-9.4 |
| Syloid W300 | Grace-Davison | $SiO_2$ | 5.3-6.3 |
| Syloid 72 | Grace-Davison | $SiO_2$ | 4.5-5.7 |
| Syloid 74 | Grace-Davison | $SiO_2$ | 5.9-7.5 |
| Syloid 244 | Grace-Davison | $SiO_2$ | 2.5-3.7 |
| Spheron L1500 | CCIC/Ikeda | $SiO_2$ | 3-15 |
| Spheron P1500 | CCIC/Ikeda | $SiO_2$ | 7 |
| ZeeoSphere G200 | 3M | $SiO_2$; $Al_2O_3$ | 5 |
| Micral 9400 | J.M. Huber | $Al(OH)_3$ | |
| Digitex 1000 | Engelhard Industries | Kaolin-based pigment | |
| Syloid SP500-11007 | Grace-Davison | $SiO_2$ | |

A preferred porous pigment is silica having an average particle size preferably between 1 and 10 μm, more preferably between 2 and 7.5 and a pore volume preferably between 0.05 and 5 ml/g, more preferably between 0.75 and 2.5 ml/g.

The total amount of porous pigment in the image receiving layer is preferably between 0.25 and 5 $g/m^2$, more preferably between 0.5 and 4.0 $g/m^2$, most preferably between 1.0 and 3.0 $g/m^2$.

Other Ingredients

The image receiving layer may in addition to the porous pigment, the aqueous dispersion of a polymer particle and the copolymer comprising alkylene and vinyl alcohol units comprise other ingredients such as matting agents, preservatives, surfactants, colorants and antistatic components.

Preferred matting agents are disclosed in EP-A 2103736, paragraphs [91] and [92]. A preferred preservative is the sodium salt of 1,2-benzisothiazolin-3-one, commercially available under the trade name Proxel and Bronidox K.

The image receiving layer may also comprise insolubilization agents such as disclosed in EP-A 2103736, paragraph [0087]-[0090].

The total dry weight of the image receiving layer is preferably between 1.0 and 10.0 $g/m^2$, more preferably between 2.0 and 8.0 g/m2, most preferably between 3.0 and 6.0 $g/m^2$.

Support

The support of the image receiving material for offset printing may be transparent or opaque.

The supports that can be used in the present invention include resin-coated cellulosic paper, webs having a fibrous structure formed with synthetic fibers and webs in which a film is directly extruded from a thermoplastic polymer. The resin-coating of resin-coated cellulosic paper can be rendered non-transparent by the inclusion of opacifying pigments therein. Webs having a fibrous structure formed with synthetic fibers and webs in which a film is directly extruded from a thermoplastic polymer can be rendered non-transparent by the inclusion of opacifying pigments. Furthermore, webs in which a film is directly extruded from a thermoplastic polymer can be also rendered non-transparent by axial stretching-induced microvoid formation resulting from the presence of poorly compatible dispersions of amorphous high polymers with a higher glass transition temperature than the glass transition temperature or melting point of the matrix polymer and/or the crystalline high polymers which melt at a higher temperature than the glass transition temperature or melting point of the matrix polymer and axially stretching the extruded film. Widely used matrix polymers include polyethylene, polypropylene, polystyrene, polyamide and polyester.

The support is preferably a synthetic paper made from polyester, polyolefin or polyvinylchloride.

The support is preferably a web in which a film is directly extruded from a thermoplastic polymer. The thermoplastic polymer is preferably a polyester. Preferably the support comprises at least 50 wt. % of a linear polyester.

According to a particularly preferred embodiment, the support is a non-transparent microvoided axially stretched directly extruded thermoplastic polymer comprising dispersed therein at least one amorphous high polymer with a higher glass transition temperature than the glass transition temperature of the thermoplastic polymer and/or at least one crystalline high polymer having a melting point which is higher than the glass transition of the thermoplastic polymer.

The thermoplastic polymer is preferably a linear polyester.

The crystalline polymer is preferably selected from the group consisting of polyethylene, preferably high density polyethylene, polypropylene, preferably isotactic polypropylene, and isotactic poly(4-methyl-1-pentene).

The amorphous polymer is preferably selected from the group consisting of polystyrene, styrene copolymers, styrene-acrylonitrile (SAN)-copolymers, polyacrylates, acrylate-copolymers, poly-methacrylates and methacrylate-copolymers.

According to a particularly preferred embodiment, the support is a non-transparent microvoided axially stretched directly extruded linear polyester having dispersed therein 5 to 20 wt. % of a styrene-acrylonitrile-block copolymer.

The support preferably also comprises an opacifying pigment, the opacifying pigment being preferably selected from the group consisting of silica, zinc oxide, zinc sulphide, barium sulphate, calcium carbonate, titanium dioxide, aluminium phosphate and clays.

Preferred opacifying pigments are $Ti0_2$ pigments. $Ti0_2$ particles may be of the anatase or the rutile type. Preferably $Ti0_2$ particles of the rutile type are used due to their higher covering power. Because $Ti0_2$ is UV-sensitive, radicals may be formed upon exposure to UV radiation, $Ti0_2$ particles are typically coated with Al, Si, Zn or Mg oxides. Preferably such $Ti0_2$ particles having an $Al_20_3$ or $Al_20_3/Si0_2$ coating are used in the present invention. Other preferred $TiO_2$ particles are disclosed in U.S. Pat. No. 6,849,325.

The support may further comprise one or more ingredients selected from the group consisting of whitening agents or optical brighteners, UV-absorbers, light stabilizers, antioxidants, flame retardants and colorants.

A particularly preferred support is disclosed in WO2008040670 and comprises a continuous phase linear polyester matrix having dispersed therein a non-crosslinked random SAN-polymer and dispersed or dissolved therein at least one ingredient from the group of ingredients consisting of inorganic opacifying pigments, whitening agents, colorants, UV-absorbers, light stabilizers, antioxidants and flame retardants, wherein the film is white, microvoided, non-transparent and axially stretched; the linear polyester matrix has monomer units consisting essentially of at least one aromatic dicarboxylic acid, at least one aliphatic diol and optionally at least one aliphatic dicarboxylic acid; the weight ratio of the linear polyester to the non-crosslinked SAN-polymer is in the range of 2.0:1 to 19.0:1; and one of said at least one aromatic dicarboxyate monomer units is isophthalate and said isophthalate is present in said polyester matrix in a concentration of 10 mole % or less of all the dicarboxylate monomer units in said linear polyester matrix.

A preferred process to prepare the support is disclosed in WO2008040699.

Subbing Layers

To improve the adhesion of the image receiving layer to the support, one or more subbing layers may be provided between the image receiving layer and the support. Preferably, the subbing layer comprises a vinylidene chloride containing copolymer, such as for example a vinylidene chloride-methacrylic-itaconic acid copolymer.

To optimize the antistatic properties of the image receiving material, the subbing layers preferably comprise an antistatic agent. Preferred antistatic agents are PEDOT/PSS dispersions as disclosed in the EP-As 564911, 570795 and 686662.

Process for Producing the Image Recording Material

Aspects of the present invention are also realized by a method for preparing an image receiving material for offset printing comprising the steps of:

(i) providing a support having two sides, (ii) optionally applying a subbing layer on one or both sides of the support, and (iii) applying the image receiving layer as described above on one or both sides of the optionally subbed support, Preferably a subbing layer and an image receiving layer are applied on both sides of the support. Even more preferred, the subbing layers and image receiving layers on both sides of the support are identical.

As the support is typically produced by an extrusion process wherein first a thick film is formed, followed by longitudinal and then transversal stretching of the thick film, the subbing layers are preferably provided after the longitudinal stretching step while the image recording layer is preferably applied after the transversal stretching step.

EXAMPLES

Materials

All materials used in the examples were readily available from standard sources such as Aldrich Chemical Co. (Belgium) and Acros (Belgium) unless otherwise specified.

$Si0_2$, a 20 wt. % dispersion in water of Syloid 244 from Grace GMBH.

Joncryl FLX 5010, a 45 wt. % dispersion in water of styrene-acrylic polymer from BASF.

PVA-1, a 3.81 wt. % aqueous solution of a fully hydrolysed (97.5-99.5 mol. %) polyvinylalcohol from ACETEX.

surfactant, a 5 wt. % solution of Zonyl FSO100 from Dupont in isopropanol.

matting agent, a methacrylate/styreneacrylate matting agent having an average particle diameter of 7-8 μm.

Exceval AQ-4104, Exceval HR-3010, Exceval RS-2117, Exceval RS-1717, Exceval RS-1713, Exceval RS-4105, Exceval RS-2713, Exceval RS-2817, 4 wt. % solution in DW/fenoxyethanol (947 g/10 g) of a vinylalcohol-vinylacetate-ethylene copolymer, all from KURARAY.

S-LEC KW-1, a 20 wt. % aqeuous solution of a vinylalcohol-vinylacetate-vinylbutyral copolymer from SEKISUI.

Polyviol LL603, a 20 wt. % aqueous solution of a vinylalcohol-vinylacetate-isopropylenealcohol-isopropyleneacetate from WACKER CHEMIE.

Polyviol LL620, a 20 wt. % aqueous solution of a vinylalcohol-vinylacetate-vinylversatate copolymer from WACKER CHEMIE.

MP103, a 4 wt. % solution in DW/fenoxyethanol (950/10) of vinylalochol-vinyacetate copolymer modified with hydrophilic and hydrophobic groups from KURARAY.

S-LEC KW-3, a 20 wt. % aqueous solution of a vinylalcohol-vinylacetate-vinylbutyral copolymer from SEKISUI.

Poval KL118, a 4 wt. % solution in DW/fenoxyethanol (950/10) of a carboxylated vinylalcohol-vinylacetate copolymer from KURARAY.

Michem EM39235, a 35 wt. % high density polyethylene wax from MICHELMAN.

Chemguard S-550, a 5 wt. % solution in isopropanol of a perfluoroalkyl polyether surfactant from CHEMGUARD.

Mersolat H, a surfactant from Lanxess.

Kieselsol 100F, a colloidal silica from HC STARCK.

PEDOT/PSS, poly(ethylene dioxythiophene)/poly(styrene sulfonic acid) sodium salt.

Dust Deposition Test on a AB-D360 Printing Press 125 sheets (size A4) of testmaterial were run 4 times through a AB-D360 printing machine. So the testmaterial made contact with the blanket for 500 times.

The deposition of dust on the blanket was evaluated qualitatively. In each examples, all samples were evaluated (+ better, − worse) against a reference (O).

Waterresistance Test

An image was printed on the test samples on a Heidelberg GTO46 printing press, using Novavit K+E800 printing ink.

After drying for at least 24 hr, part of the printed samples was put in a cup, filled with tapwater for 24 hours.

Subsequently, the wet sample was scratched three times with a fingernail. The damage on the printed image was evaluated qualitatively. In each examples, all samples were evaluated (+ better, − worse) against a reference (O).

Example 1

Preparation of the Support

A subbing layer with a composition of Table 5 was provided on both sides of the support. The support has been prepared as disclosed in EP-A 2103736 (example 1 and example 1/LS1/BS1; page 19, Tables 1 and 2).

TABLE 5

| Ingredient | mg/m$^2$ |
|---|---|
| PEDOT/PSS (1/2.46) | 3.33 |
| copolymer of 88% vinylidene chloride, 10% methyl acrylate and 2% itaconic acid | 294.54 |
| Mersolat H | 0.11 |
| Kieselsol 100F-30 | 32.72 |
| D-Glucose | 24.90 |
| Sorbitol | 57.00 |

Example 2

The coating solutions with a composition as given in Table 6 were applied on the support described in EXAMPLE 1 at a thickness of 33 μm at a coating temperature of 45° C.

TABLE 6

| Ingredients (g) | COMP-01 | INV-01 | INV-02 | INV-03 | INV-04 |
|---|---|---|---|---|---|
| DW | 873.5 | 899.5 | 899.5 | 899.5 | 899.5 |
| $Si0_2$ | 1050.0 | 1050.0 | 1050.0 | 1050.0 | 1050.0 |
| Joncryl FLX 5010 | 466.0 | 466.0 | 466.0 | 466.0 | 466.0 |
| PVA-1 | 550.5 | — | — | — | — |
| Exceval RS4104 | — | 524.5 | — | — | — |
| Exceval HR3010 | — | — | 524.5 | — | — |
| Exceval RS2117 | — | — | — | 524.5 | — |
| Exceval RS1717 | — | — | — | — | 524.5 |
| surfactant | 15.0 | 15.0 | 15.0 | 15.0 | 15.0 |
| matting agent | 45.0 | 45.0 | 45.0 | 45.0 | 45.0 |

| Ingredients (g) | INV-05 | INV-06 | INV-07 | INV-08 |
|---|---|---|---|---|
| DW | 899.5 | 899.5 | 899.5 | 899.5 |
| $Si0_2$ | 1050.0 | 1050.0 | 1050.0 | 1050.0 |
| Joncryl FLX 5010 | 466.0 | 466.0 | 466.0 | 466.0 |
| Exceval RS1713 | 524.5 | — | — | — |
| Exceval RS4105 | — | 524.5 | — | — |
| Exceval RS2713 | — | — | 524.5 | — |
| Exceval RS2817 | — | — | — | 524.5 |
| surfactant | 15.0 | 15.0 | 15.0 | 15.0 |
| matting agent | 45.0 | 45.0 | 45.0 | 45.0 |

The pH of the coating solutions was adjusted to 8.1 with an 25 wt % aqueous $NH_3$ solution.

The dry coating weight of the ingredients are given in Table 7.

TABLE 7

| Dry weight (g/m$^2$) | COMP-01 | INV-01 | INV-02 | INV-03 | INV-04 |
|---|---|---|---|---|---|
| Joncryl FLX 5010 | 2.31 | 2.31 | 2.31 | 2.31 | 2.31 |
| PVA-1 | 0.23 | — | — | — | — |
| Exceval RS4104 | — | 0.23 | — | — | — |
| Exceval HR3010 | — | — | 0.23 | — | — |
| Exceval RS2117 | — | — | — | 0.23 | — |
| Exceval RS1717 | — | — | — | — | 0.23 |
| $Si0_2$ | 2.31 | 2.31 | 2.31 | 2.31 | 2.31 |
| Matting agent | 0.10 | 0.10 | 0.10 | 0.10 | 0.10 |
| Surfactant | 0.094 | 0.094 | 0.093 | 0.093 | 0.093 |
| Total | 4.96 | 4.96 | 4.96 | 4.96 | 4.96 |

| Dry weight (g/m$^2$) | INV-05 | INV-06 | INV-07 | INV-08 |
|---|---|---|---|---|
| Joncryl FLX 5010 | 2.31 | 2.31 | 2.31 | 2.31 |
| Exceval RS1713 | 0.23 | — | — | — |
| Exceval RS4105 | — | 0.23 | — | — |
| Exceval RS2713 | — | — | 0.23 | — |
| Exceval RS2817 | — | — | — | 0.23 |
| $Si0_2$ | 2.31 | 2.31 | 2.31 | 2.31 |
| Matting agent | 0.10 | 0.10 | 0.10 | 0.10 |
| Surfactant | 0.094 | 0.094 | 0.093 | 0.093 |
| Total | 4.96 | 4.96 | 4.96 | 4.96 |

All samples were subjected to both the dust test and the water resistance test. The results are shown in Table 8.

TABLE 8

| | Water soluble binder | Hydrolysis (mol. %) | ethylene | Dust | $H_20$ resistance |
|---|---|---|---|---|---|
| COMP-01 | PVA-1 | 97.5-99.5 | 0 | 0 | 0 |
| INV-01 | Exceval AQ-4104 | 98.0-99.0 | 4 | + | +++ |
| INV-02 | Exceval HR-3010 | 99.0-99.4 | 3 | + | 0 |
| INV-03 | Exceval RS-2117 | 97.5-99.0 | 2 | 0/+ | + |
| INV-04 | Exceval RS-1717 | 92.0-94.0 | 1 | 0/+ | 0 |
| INV-05 | Exceval RS-1713 | | 1 | + | 0 |
| INV-06 | Exceval RS-4105 | 97.5-99.0 | 4 | + | ++ |
| INV-07 | Exceval RS-2713 | 92.0-94.0 | 2 | + | −− |
| INV-08 | Exceval RS-2817 | 95.5-97.5 | 2 | + | + |

It is clear from the results of Table 8 that all samples with a vinylalcohol-vinylacetate-ethylene copolymer have improved properties compared with the comparative example having a vinylalcohol-vinylacetate copolymer. The best results are obtained with those copolymers having the highest ethylene content (INV-01 and INV-06).

Example 3

In example 3, a variety of copolymers were tested.

The coating solutions with a composition as given in Table 9 were applied on the support described in EXAMPLE 1 at a thickness of 33 μm at a coating temperature of 45° C.

TABLE 9

| Ingredients (g) | COMP-02 | COMP-03 | INV-09 | COMP-04 | COMP-05 |
|---|---|---|---|---|---|
| DW | 873.5 | 899.5 | 899.5 | 1319.0 | 1319.0 |
| $Si0_2$ | 1050.0 | 1050.0 | 1050.0 | 1050.0 | 1050.0 |
| Joncryl FLX 5010 | 466.0 | 466.0 | 466.0 | 466.0 | 466.0 |
| PVA-1 | 550.5 | — | — | — | — |
| Poval 103 | — | 524.5 | — | — | — |
| Exceval RS4104 | — | — | 524.5 | — | — |
| S LEC KW-1 | — | — | — | 105.0 | — |
| Polyviol LL603 | — | — | — | — | 105.0 |
| surfactant | 15.0 | 15.0 | 15.0 | 15.0 | 15.0 |
| matting agent | 45.0 | 45.0 | 45.0 | 45.0 | 45.0 |

| Ingredients (g) | COMP-06 | COMP-07 | COMP-08 | INV-10 | COMP-09 |
|---|---|---|---|---|---|
| DW | 1319.0 | 899.5 | 1319.0 | 899.5 | 899.5 |
| $Si0_2$ | 1050.0 | 1050.0 | 1050.0 | 1050.0 | 1050.0 |
| Joncryl FLX 5010 | 466.0 | 466.0 | 466.0 | 466.0 | 466.0 |
| Polyviol LL620 | 105.0 | — | — | — | — |
| MP103 | — | 524.5 | — | — | — |
| S LEC KW-3 | — | — | 105.0 | — | — |

TABLE 9-continued

| | | | | | |
|---|---|---|---|---|---|
| Exceval RS4105 | — | — | — | 524.5 | — |
| Poval KL118 | — | — | — | — | 524.5 |
| surfactant | 15.0 | 15.0 | 15.0 | 15.0 | 15.0 |
| matting agent | 45.0 | 45.0 | 45.0 | 45.0 | 45.0 |

The pH of the coating solutions was adjusted to 8.1 with an 25 wt. % aqueous $NH_3$ solution.

The dry coating weight of the ingredients are given in Table 10.

TABLE 10

| Dry weight ($g/m^2$) | COMP-02 | COMP-03 | INV-09 | COMP-04 | COMP-05 |
|---|---|---|---|---|---|
| Joncryl FLX 5010 | 2.31 | 2.31 | 2.31 | 2.31 | 2.31 |
| PVA-1 | 0.23 | — | — | — | — |
| Poval 103 | — | 0.23 | — | — | — |
| Exceval RS4104 | — | — | 0.23 | — | — |
| S LEC KW-1 | — | — | — | 0.23 | — |
| Polyviol LL603 | — | — | — | — | 0.23 |
| $Si0_2$ | 2.31 | 2.31 | 2.31 | 2.31 | 2.31 |
| Matting agent | 0.10 | 0.10 | 0.10 | 0.10 | 0.10 |
| Surfactant | 0.094 | 0.094 | 0.093 | 0.093 | 0.093 |
| Total | 4.96 | 4.96 | 4.96 | 4.96 | 4.96 |

| Dry weight ($g/m^2$) | COMP-06 | COMP-07 | COMP-08 | INV-10 | COMP-09 |
|---|---|---|---|---|---|
| Joncryl FLX 5010 | 2.31 | 2.31 | 2.31 | 2.31 | 2.31 |
| Polyviol LL620 | 0.23 | — | — | — | — |
| MP103 | — | 0.23 | — | — | — |
| S LEC KW-3 | — | — | 0.23 | — | — |
| Exceval RS4105 | — | — | — | 0.23 | — |
| Poval KL118 | — | — | — | — | 0.23 |
| $Si0_2$ | 2.31 | 2.31 | 2.31 | 2.31 | 2.31 |
| Matting agent | 0.10 | 0.10 | 0.10 | 0.10 | 0.10 |
| Surfactant | 0.094 | 0.094 | 0.093 | 0.093 | 0.093 |
| Total | 4.96 | 4.96 | 4.96 | 4.96 | 4.96 |

All samples were subjected to both the dust test and the water resistance test. The results are shown in Table 11.

TABLE 11

| | | Dust | $H_2O$ resistance |
|---|---|---|---|
| COMP-02 | PVA-1 | 0 | 0 |
| COMP-03 | Poval 103 | ++ | −−− |
| INV-09 | Exceval RS4104 | ++ | ++ |
| COMP-04 | S LEC KW-1 | 0 | − |
| COMP-05 | Polyviol LL603 | + | 0 |
| COMP-06 | Polyviol LL620 | ++ | −− |
| COMP-07 | MP103 | + | −− |
| COMP-08 | S LEC KW-3 | 0 | −− |
| INV-10 | Exceval RS4105 | ++ | 0/− |
| COMP-09 | Poval KL118 | + | 0 |

It is clear form the results of Table 11 that the best results with respect to dust formation and water resistance are obtained with those samples comprising a vinyl alcohol-vinylacetate-ethylene copolymer.

Example 4

The coating solutions with a composition as given in Table 12 were applied on the support described in EXAMPLE 1 at a thickness of 33 μm at a coating temperature of 45° C.

TABLE 12

| Ingredients (g) | INV-11 | INV-12 | INV-13 | INV-14 | INV-15 |
|---|---|---|---|---|---|
| DW | 1292.0 | 953.0 | 966.0 | 979.0 | 613.0 |
| $Si0_2$ | 819.0 | 819.0 | 819.0 | 819.0 | 819.0 |
| Joncryl FLX 5010 | 464.0 | 464.0 | 464.0 | 464.0 | 464.0 |
| Michem EM39235 | 26.0 | 26.0 | 13.0 | — | 26.0 |
| Exceval RS4104 | 339.0 | 678.0 | 678.0 | 678.0 | 1018.0 |
| Chemguard S550 | 15.0 | 15.0 | 15.0 | 15.0 | 15.0 |
| Matting agent | 45.0 | 45.0 | 45.0 | 45.0 | 45.0 |

| Ingredients (g) | INV-16 | INV-17 | INV-18 | INV-19 | INV-20 |
|---|---|---|---|---|---|
| DW | 1383.0 | 1044.0 | 1057.0 | 1070.0 | 704.0 |
| $Si0_2$ | 728.0 | 728.0 | 728.0 | 728.0 | 728.0 |
| Joncryl FLX 5010 | 464.0 | 464.0 | 464.0 | 464.0 | 464.0 |
| Michem EM39235 | 26.0 | 26.0 | 13.0 | — | 26.0 |
| Exceval RS4104 | 339.0 | 678.0 | 678.0 | 678.0 | 1018.0 |
| Chemguard S550 | 15.0 | 15.0 | 15.0 | 15.0 | 15.0 |
| Matting agent | 45.0 | 45.0 | 45.0 | 45.0 | 45.0 |

| Ingredients (g) | INV-21 | INV-22 | INV-23 | INV-24 | INV-25 |
|---|---|---|---|---|---|
| DW | 1475.0 | 1136.0 | 1149.0 | 1162.0 | 796.0 |
| $Si0_2$ | 636.0 | 636.0 | 636.0 | 636.0 | 636.0 |
| Joncryl FLX 5010 | 464.0 | 464.0 | 464.0 | 464.0 | 464.0 |
| Michem EM39235 | 26.0 | 26.0 | 13.0 | — | 26.0 |
| Exceval RS4104 | 339.0 | 678.0 | 678.0 | 678.0 | 1018.0 |
| Chemguard S550 | 15.0 | 15.0 | 15.0 | 15.0 | 15.0 |
| Matting agent | 45.0 | 45.0 | 45.0 | 45.0 | 45.0 |

The pH of the coating solutions was adjusted to 8.1 with an 25 wt. % aqueous $NH_3$ solution.

The dry coating weight of the ingredients are given in Table 13.

TABLE 13

| Dry weight ($g/m^2$) | INV-11 | INV-12 | INV-13 | INV-14 | INV-15 |
|---|---|---|---|---|---|
| $Si0_2$ | 1.80 | 1.80 | 1.80 | 1.80 | 1.80 |
| Joncryl FLX 5010 | 2.30 | 2.30 | 2.30 | 2.30 | 2.30 |
| Michem EM39235 | 0.1 | 0.1 | 0.05 | — | 0.1 |
| Exceval RS4104 | 0.15 | 0.30 | 0.30 | 0.30 | 0.45 |
| Chemguard S550 | 0.0083 | 0.0083 | 0.0083 | 0.0083 | 0.0083 |
| Matting agent | 0.10 | 0.10 | 0.10 | 0.10 | 0.10 |

| Dry weight ($g/m^2$) | INV-16 | INV-17 | INV-18 | INV-19 | INV-20 |
|---|---|---|---|---|---|
| $Si0_2$ | 1.60 | 1.60 | 1.60 | 1.60 | 1.60 |
| Joncryl FLX 5010 | 2.30 | 2.30 | 2.30 | 2.30 | 2.30 |
| Michem EM39235 | 0.1 | 0.1 | 0.05 | — | 0.1 |
| Exceval RS4104 | 0.15 | 0.30 | 0.30 | 0.30 | 0.45 |
| Chemguard S550 | 0.0083 | 0.0083 | 0.0083 | 0.0083 | 0.0083 |
| Matting agent | 0.10 | 0.10 | 0.10 | 0.10 | 0.10 |

| Dry weight ($g/m^2$) | INV-21 | INV-22 | INV-23 | INV-24 | INV-25 |
|---|---|---|---|---|---|
| $Si0_2$ | 1.40 | 1.40 | 1.40 | 1.40 | 1.40 |
| Joncryl FLX 5010 | 2.30 | 2.30 | 2.30 | 2.30 | 2.30 |
| Michem EM39235 | 0.1 | 0.1 | 0.05 | — | 0.1 |
| Exceval RS4104 | 0.15 | 0.30 | 0.30 | 0.30 | 0.45 |
| Chemguard S550 | 0.0083 | 0.0083 | 0.0083 | 0.0083 | 0.0083 |
| Matting agent | 0.10 | 0.10 | 0.10 | 0.10 | 0.10 |

The results of the water resistance test are given in Table 14.

TABLE 14

| | Water resistance |
|---|---|
| INV-11 | 0 |
| INV-12 | 0/+ |
| INV-13 | + |
| INV-14 | + |
| INV-15 | + |
| INV-16 | 0 |
| INV-17 | + |
| INV-18 | ++ |
| INV-19 | ++ |
| INV-20 | ++ |
| INV-21 | 0 |
| INV-22 | + |
| INV-23 | ++ |
| INV-24 | ++ |
| INV-25 | ++ |

The best results are obtained with those samples having the highest concentration of vinylalcohol-vinylacetate-ethylene copolymer.

Example 5

The coating solutions with a composition as given in Table 15 were applied on the support described in EXAMPLE 1 at a thickness of 33 μm at a coating temperature of 45° C.

TABLE 15

| Ingredients (g) | INV-26 | INV-27 | INV-28 | INV-29 | INV-30 |
|---|---|---|---|---|---|
| DW | 1292.0 | 1383.0 | 1775.0 | 1565.0 | 1656.0 |
| $SiO_2$ | 819.0 | 728.0 | 636.0 | 546.0 | 455.0 |
| Joncryl FLX 5010 | 464.0 | 464.0 | 464.0 | 464.0 | 464.0 |
| Michem EM39235 | 26.0 | 26.0 | 13.0 | — | 26.0 |
| Exceval RS4104 | 339.0 | 339.0 | 339.0 | 339.0 | 339.0 |
| Chemguard S550 | 15.0 | 15.0 | 15.0 | 15.0 | 15.0 |
| Matting agent | 45.0 | 45.0 | 45.0 | 45.0 | 45.0 |

| Ingredients (g) | INV-31 | INV-32 | INV-33 | COMP-10 | INV-34 |
|---|---|---|---|---|---|
| DW | 0 | 953.0 | 1461.0 | 1631.0 | 1318.0 |
| $SiO_2$ | 819.0 | 819.0 | 819.0 | 819.0 | 819.0 |
| Joncryl FLX 5010 | 464.0 | 464.0 | 464.0 | 464.0 | 464.0 |
| Michem EM39235 | 26.0 | 26.0 | 13.0 | — | 26.0 |
| Exceval RS4104 | 1631.0 | 678.0 | 170.0 | — | 339.0 |
| Chemguard S550 | 15.0 | 15.0 | 15.0 | 15.0 | 15.0 |
| Matting agent | 45.0 | 45.0 | 45.0 | 45.0 | 45.0 |

| Ingredients (g) | INV-35 | INV-36 | INV-37 |
|---|---|---|---|
| DW | 1253.0 | 1187.0 | 1058.0 |
| $SiO_2$ | 819.0 | 819.0 | 819.0 |
| Joncryl FLX 5010 | 464.0 | 464.0 | 464.0 |
| Michem EM39235 | 65.0 | 131.0 | 260.0 |
| Exceval RS4104 | 339.0 | 339.0 | 339.0 |
| Chemguard S550 | 15.0 | 15.0 | 15.0 |
| Matting agent | 45.0 | 45.0 | 45.0 |

The pH of the coating solutions was adjusted to 8.1 with an 25 wt. % aqueous $NH_3$ solution.

The dry coating weight of the ingredients are given in Table 16.

TABLE 16

| Dry weight (g/m$^2$) | INV-26 | INV-27 | INV-28 | INV-29 | INV-30 |
|---|---|---|---|---|---|
| $SiO_2$ | 1.80 | 1.60 | 1.40 | 1.20 | 1.00 |
| Joncryl FLX 5010 | 2.30 | 2.30 | 2.30 | 2.30 | 2.30 |
| Michem EM39235 | 0.10 | 0.10 | 0.10 | 0.10 | 0.10 |
| Exceval RS4104 | 0.15 | 0.15 | 0.15 | 0.15 | 0.15 |
| Chemguard S550 | 0.0083 | 0.0083 | 0.0083 | 0.0083 | 0.0083 |
| Matting agent | 0.10 | 0.10 | 0.10 | 0.10 | 0.10 |

| Dry weight (g/m$^2$) | INV-31 | INV-32 | INV-33 | COMP-10 | INV-34 |
|---|---|---|---|---|---|
| $SiO_2$ | 1.80 | 1.80 | 1.80 | 1.80 | 1.80 |
| Joncryl FLX 5010 | 2.30 | 2.30 | 2.30 | 2.30 | 2.30 |
| Michem EM39235 | 0.10 | 0.10 | 0.10 | 0.10 | — |
| Exceval RS4104 | 0.75 | 0.30 | 0.07 | — | 0.15 |
| Chemguard S550 | 0.0083 | 0.0083 | 0.0083 | 0.0083 | 0.0083 |
| Matting agent | 0.10 | 0.10 | 0.10 | 0.10 | 0.10 |

| Dry weight (g/m$^2$) | INV-35 | INV-36 | INV-37 |
|---|---|---|---|
| $SiO_2$ | 1.80 | 1.80 | 1.80 |
| Joncryl FLX 5010 | 2.30 | 2.30 | 2.30 |
| Michem EM39235 | 0.25 | 0.50 | 1.00 |
| Exceval RS4104 | 0.15 | 0.15 | 0.15 |
| Chemguard S550 | 0.0083 | 0.0083 | 0.0083 |
| Matting agent | 0.10 | 0.10 | 0.10 |

All samples were subjected to both the dust test and the water resistance test. The results are shown in Table 17.

TABLE 17

| | dust | Water resistance |
|---|---|---|
| INV-26 | 0 | 0 |
| INV-27 | 0 | 0 |
| INV-28 | 0 | 0 |
| INV-29 | 0 | 0 |
| INV-30 | 0 | 0 |
| INV-31 | – | +++ |
| INV-32 | ++ | +++ |
| INV-33 | 0 | 0 |
| COMP-10 | – | 0 |
| INV-34 | + | 0 |
| INV-35 | + | 0 |
| INV-36 | ++ | 0 |
| INV-37 | ++ | 0 |

It is clear from the results of Table 17 that all inventive samples comprising a vinylalcohol-vinylacetate-ethylene copolymer have better dust and water resistance properties compared to the sample having no such copolymer. The best water resistance is obtained with those samples having the highest concentration of the water soluble or dispersible copolymer (INV-31 and INV-32). A higher amount of wax also improves the dust deposition (INV-36 and INV-37).

The invention claimed is:

1. An image receiving material for offset printing comprising a support and an image receiving layer, the image receiving layer comprising a porous pigment and an aqueous dispersion of a polymer particle, wherein the image receiving layer further comprises between 0.05 and 1.0 g/m$^2$ of a copolymer which comprises vinyl alcohol, vinyl acetate, and ethylene units, wherein the copolymer comprising vinyl alcohol, vinyl acetate, and ethylene units is water soluble and is prepared by hydrolysis of a copolymer comprising vinyl acetate and ethylene units, the vinyl acetate units being converted by hydrolysis to vinyl alcohol units, wherein the content of the ethylene units of the copolymer comprising vinyl alcohol, vinyl acetate, and ethylene units is between 0.1 and 20 wt %.

2. The image receiving material according to claim 1, wherein the degree of hydrolysis of the vinyl acetate units is at least 90 mol %.

3. The image receiving material according claim 1, wherein the image receiving layer further comprises a wax.

4. The image receiving material according to claim 3, wherein the wax is a high density polyethylene wax.

5. The image receiving material according to claim 1, wherein the aqueous dispersion of a polymer particle is an anionic acrylic or urethane latex.

6. The image receiving material according to claim 1, wherein the ratio of the amount of the copolymer comprising vinyl alcohol, vinyl acetate, and ethylene units to the amount of the porous pigment is between 0.10 and 0.25.

7. The image receiving material according to claim 1, wherein the porous pigment is silica.

8. The image receiving material according to claim 1, wherein the support is a synthetic paper made from a polyester, a polyolefin or a polyvinylchloride.

9. The image receiving material according to claim 1, wherein the support is a non-transparent microvoided axially stretched directly extruded thermoplastic polymer comprising dispersed therein at least one amorphous high polymer with a higher glass transition temperature than the glass transition temperature of the thermoplastic polymer and/or at least one crystalline high polymer having a melting point which is higher than the glass transition of the thermoplastic polymer.

10. A method for preparing an image receiving material for offset printing comprising the steps of:

providing a support having two sides, optionally applying a subbing layer on one or both sides of the support, and applying an image receiving layer as defined in claim 1 on one or both sides of the optionally subbed support.

* * * * *